US007949274B2

(12) United States Patent
Furuyama

(10) Patent No.: US 7,949,274 B2
(45) Date of Patent: May 24, 2011

(54) FIXING APPARATUS AND TEMPERATURE CONTROL METHOD

(75) Inventor: Noboru Furuyama, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 468 days.

(21) Appl. No.: 12/055,829

(22) Filed: Mar. 26, 2008

(65) Prior Publication Data

US 2008/0292348 A1 Nov. 27, 2008

Related U.S. Application Data

(60) Provisional application No. 60/940,250, filed on May 25, 2007.

(51) Int. Cl.
*G03G 15/20* (2006.01)

(52) U.S. Cl. ..... 399/69; 399/45; 399/70

(58) Field of Classification Search ..... 399/69; 347/156, 212

See application file for complete search history.

(56) References Cited

U.S. PATENT DOCUMENTS 5,978,618 A * 11/1999 Yamamoto et al. ..... 399/69
2006/0198646 A1 * 9/2006 Funabiki et al. ..... 399/45
2007/0291099 A1 12/2007 Furuyama

FOREIGN PATENT DOCUMENTS

JP 08-211769 8/1996

* cited by examiner

*Primary Examiner* — David M Gray
*Assistant Examiner* — Roy Yi
(74) *Attorney, Agent, or Firm* — Turocy & Watson, LLP

(57) ABSTRACT

In a fixing apparatus having a first roller which includes a first heater and a second heater arranged in difference ranges from each other in the direction of rotation axis and an auxiliary heater arranged in a range including the ranges where the first and second heaters are arranged in the direction of rotation axis, and a second roller which is heated by a third heater and nips and carries a sheet in cooperation with the first roller, predetermined timing accompanied by start of fixing processing in the fixing apparatus is determined, and when it is determined that the predetermined timing has been reached, the quantity of power supply to the third heater is reduced and power supply to the auxiliary heater is started.

20 Claims, 14 Drawing Sheets

FIG. 14

| HEATING ROLLER TEMPERATURE | PRESSURIZING ROLLER COPY STOP TEMPERATURE |
|---|---|
| BELOW 155°C | 140°C |
| 155°C OR ABOVE, AND BELOW 160°C | 120°C |
| 160°C OR ABOVE, AND BELOW 165°C | 100°C |
| 165°C OR ABOVE | 90°C |

FIXING APPARATUS AND TEMPERATURE CONTROL METHOD

BACKGROUND OF THE INVENTION

1. Field of the Invention

The present invention relates to fixing apparatus that fixes a developer image onto a sheet by heating, and particularly to a temperature control technique to control heat applied to a sheet.

2. Description of the Related Art

Traditionally, a technique of increasing heat capacity of a roller and power of a heat source has been known in order to avoid troubles caused by temperature fall in the roller in the case of performing fixing processing to a large number of sheets at a high speed in a fixing apparatus that fixes a developer image onto a sheet by heating (see, for example, JP-A-8-211769).

However, with the traditional technique, in an image processing apparatus having a scanner, power required for turning on a scanner lamp is distributed to an auxiliary heater of the fixing apparatus when the scanner is stopped. Therefore, there is a problem fixing processing to a large number of sheets cannot be carried out at a high speed while the scanner is being operated.

SUMMARY OF THE INVENTION

An object of an embodiment of the present invention is to provide a technique which enables restraining the temperature fall in a heating roller and a pressurizing roller due to passing of paper or the like at the time of fixing processing, without significantly increasing power consumption by the entire fixing apparatus.

A fixing apparatus according to an aspect of the invention is a fixing apparatus that fixes a developer image onto a sheet by heating. The fixing apparatus includes: a first heater which is arranged in a first range in the direction of a rotation axis of a first roller and heats the first roller; a second heater which is arranged in a second range different from the first range in the direction of the rotation axis of the first roller and heats the first roller; an auxiliary heater which is arranged in a third range including the first and second ranges in the direction of the rotation axis of the first roller and heats the first roller; a third heater which heats a second roller nipping and carrying a sheet in cooperation with the first roller; and a heating control unit configured to reduce a quantity of power supply to the third heater in predetermined timing accompanied by start of fixing processing in the fixing apparatus, and starts power supply to the auxiliary heater.

A fixing apparatus according to another aspect of the invention is a fixing apparatus that fixes a developer image onto a sheet by heating. The fixing apparatus includes: a first heater which is arranged in a first range in the direction of a rotation axis of a first roller and heats the first roller; a second heater which is arranged in a second range different from the first range in the direction of the rotation axis of the first roller and heats the first roller; an auxiliary heater which is arranged in a third range including the first and second ranges in the direction of the rotation axis of the first roller and heats the first roller; a third heater which heats a second roller nipping and carrying a sheet in cooperation with the first roller; and heating control means for reducing a quantity of power supply to the third heater in predetermined timing accompanied by start of fixing processing in the fixing apparatus, and starting power supply to the auxiliary heater.

A temperature control method according to still another aspect of the invention is a temperature control method for a fixing apparatus that fixes a developer image onto a sheet by heating. The fixing apparatus includes a first roller which has first and second heaters arranged in different ranges from each other in the direction of a rotation axis and an auxiliary heater arranged in a range including the ranges where the first and second heaters are arranged in the direction of the rotation axis, and a second roller which is heated by a third heater and nips and carries a sheet in cooperation with the first roller. The method includes determining predetermined timing accompanied by start of fixing processing in the fixing apparatus, and when it is determined that the predetermined timing has been reached, reducing quantity of power supply to the third heater and starting power supply to the auxiliary heater.

BRIEF DESCRIPTION OF THE DRAWINGS

FIG. 14 is a table for explaining a method of setting the fixing processing stop temperature.

DESCRIPTION OF THE EMBODIMENTS

Hereinafter, embodiments of the invention will be described with reference to the drawings.

Figure 1:
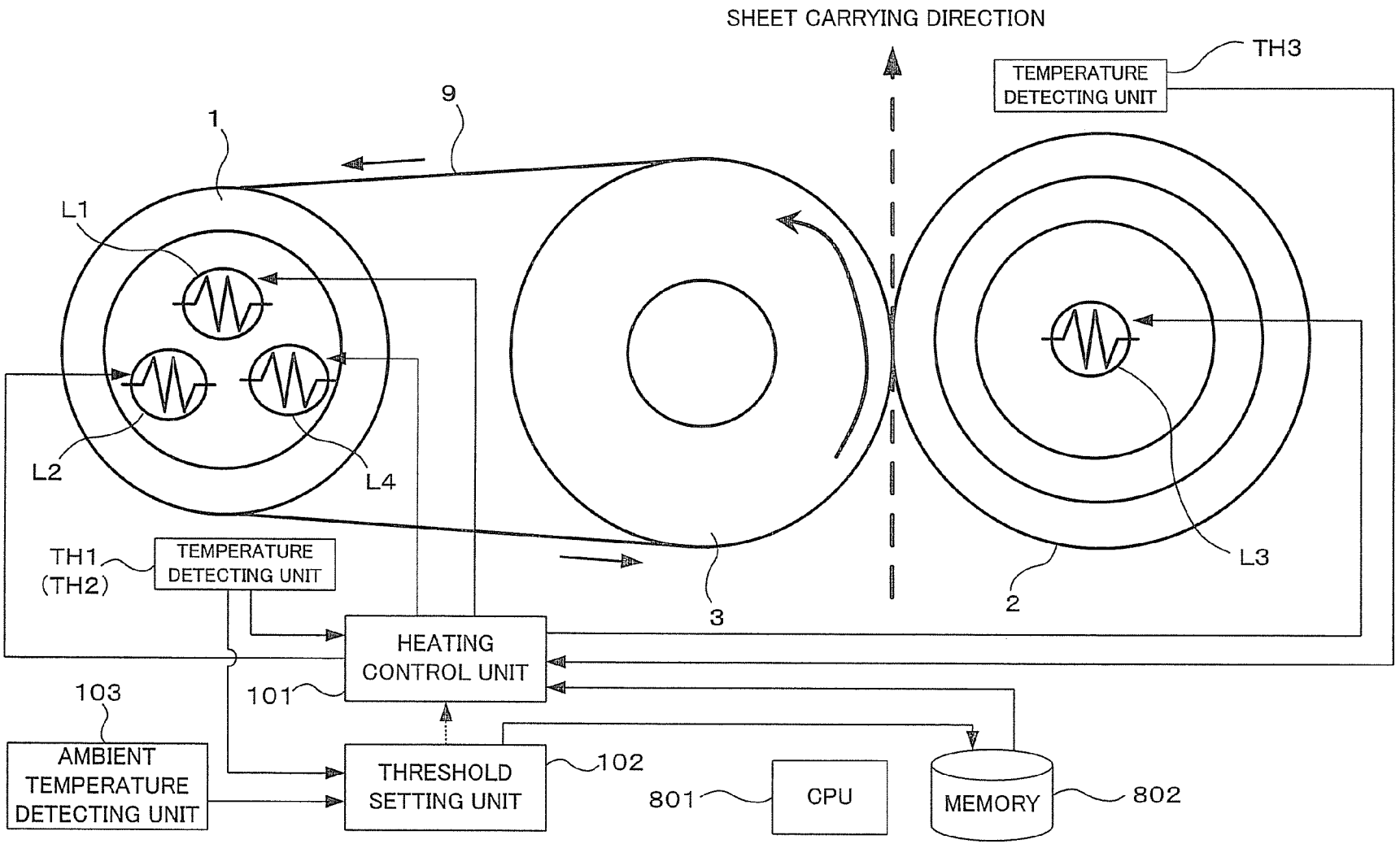
FIG. 1 is a functional block diagram for explaining a fixing apparatus according to an embodiment of the invention.
Figure 2:
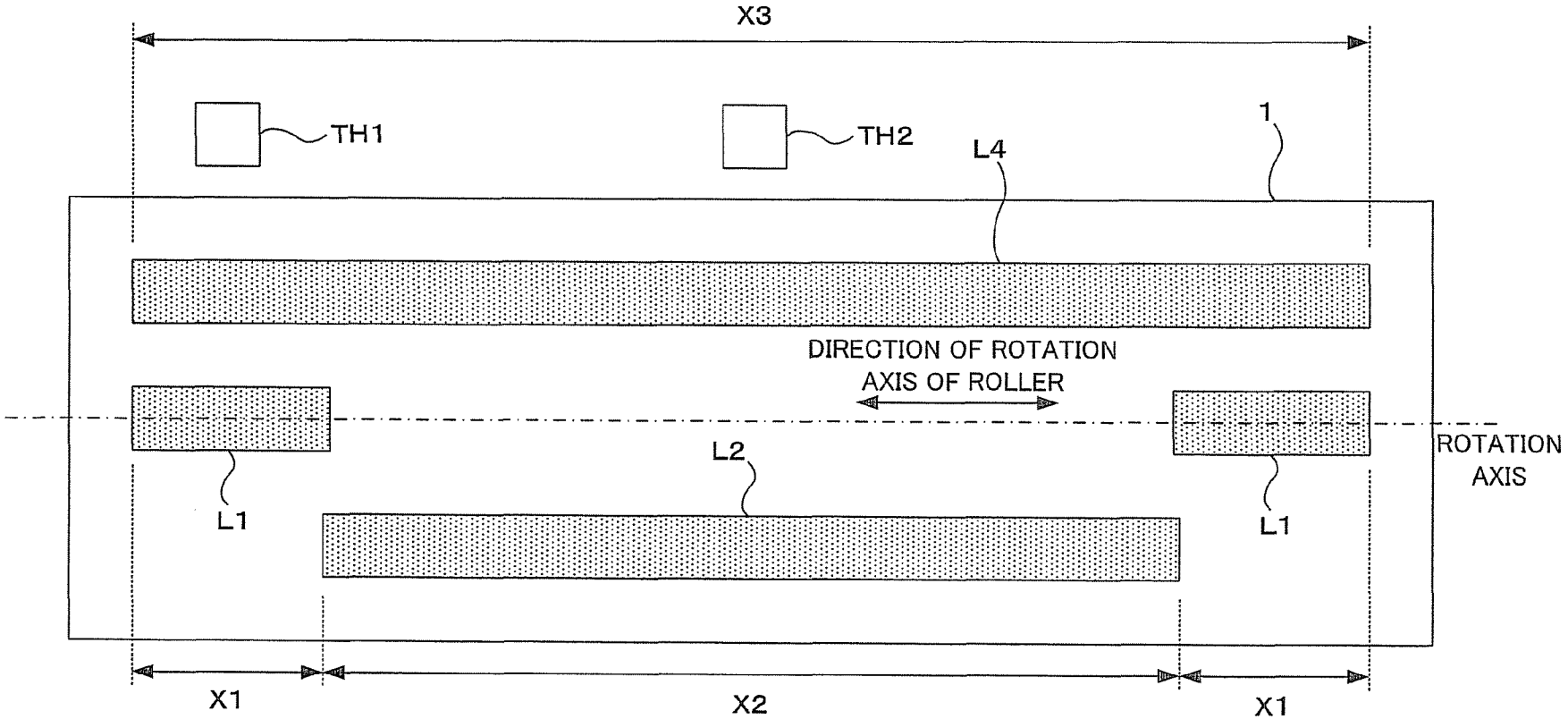
FIG. 2 is a view for explaining heater arrangement in a heating roller in the fixing apparatus according to the embodiment of the invention.

FIG. 1 is a functional block diagram for explaining a fixing apparatus according to an embodiment of the invention. FIG. 2 is a view for explaining heater arrangement in a heating roller in the fixing apparatus according to the embodiment of the invention.

The fixing apparatus according to this embodiment has a heating control unit 101, a threshold setting unit 102, an ambient temperature detecting unit 103, temperature detecting units TH1 to TH3, a first roller 1 (equivalent to a so-called heating roller) having a first heater L1, a second heater L2 and an auxiliary heater L4, a second roller 2 (equivalent to a so-called pressurizing roller) having a third heater L3, a third roller 3, a belt 9 (equivalent to a so-called fixing belt), a CPU 801, and a memory 802.

In the fixing apparatus according to this embodiment, the belt 9 is wound on the first roller 1 and the third roller 3. The roller surface of the second roller 2 is arranged to be butted against the belt surface of the belt 9. As these roller and belt surfaces nip and carry a sheet in the direction of a broken-line arrow (see FIG. 1), a developer image formed on the sheet is fixed to the sheet by heating.

Here, in the configuration of this example, a sheet is nipped and carried by the belt 9 wound on the first roller 1 and the third roller 3, and the second roller 2. However, the configuration is not limited to this. For example, a sheet can be nipped and carried between the roller surface of the first roller 1 and the roller surface of the second roller 2, as a matter of course. In this way, "cooperation" between the second roller 2 and the first roller 1 may include a case where the second roller 2 and the first roller 1 indirectly interact via the belt or the like, thus nipping and carrying a sheet.

Hereinafter, each element forming the fixing apparatus according to this embodiment will be described in detail.

Figure 3:
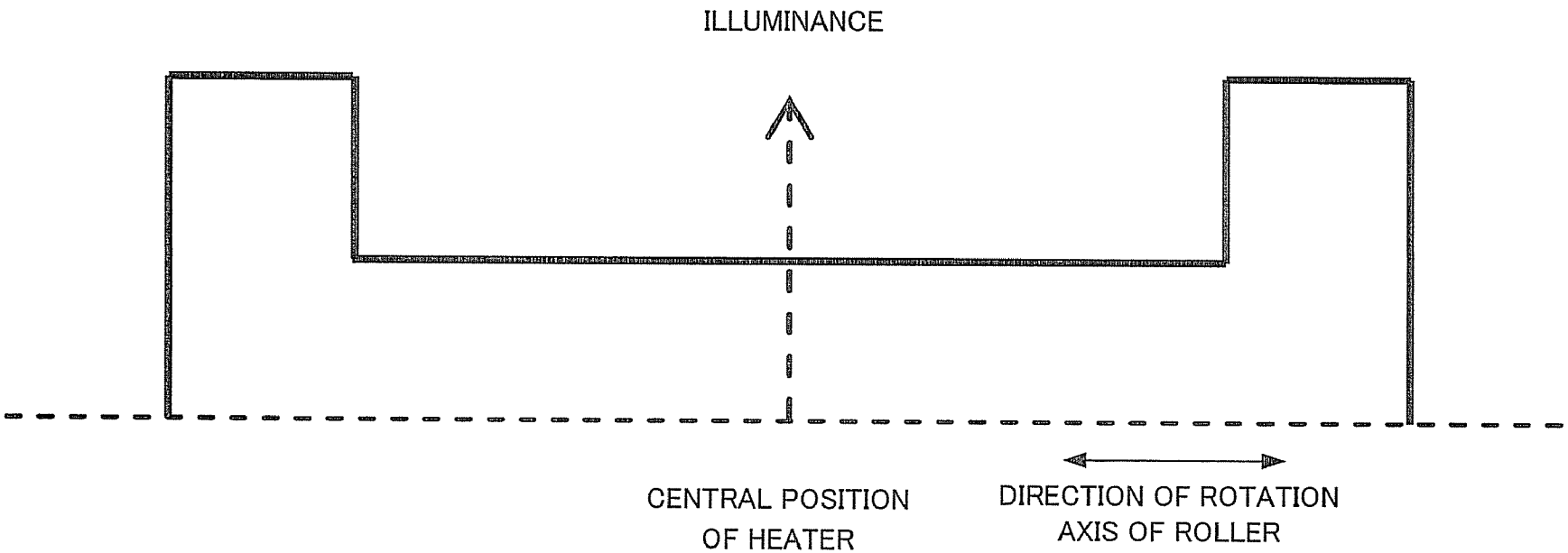
FIG. 3 is a graph showing illuminance distribution in a first heater L1.

The first heater L1 is arranged in a first range X1 in the direction of the rotation axis of the first roller 1 (the main heating target area is the vicinity of both edges of the first roller; see FIG. 2). The first heater L1 thus serves to heat the first roller 1. FIG. 3 is a graph showing illuminance distribution in the first heater L1.

Figure 4:
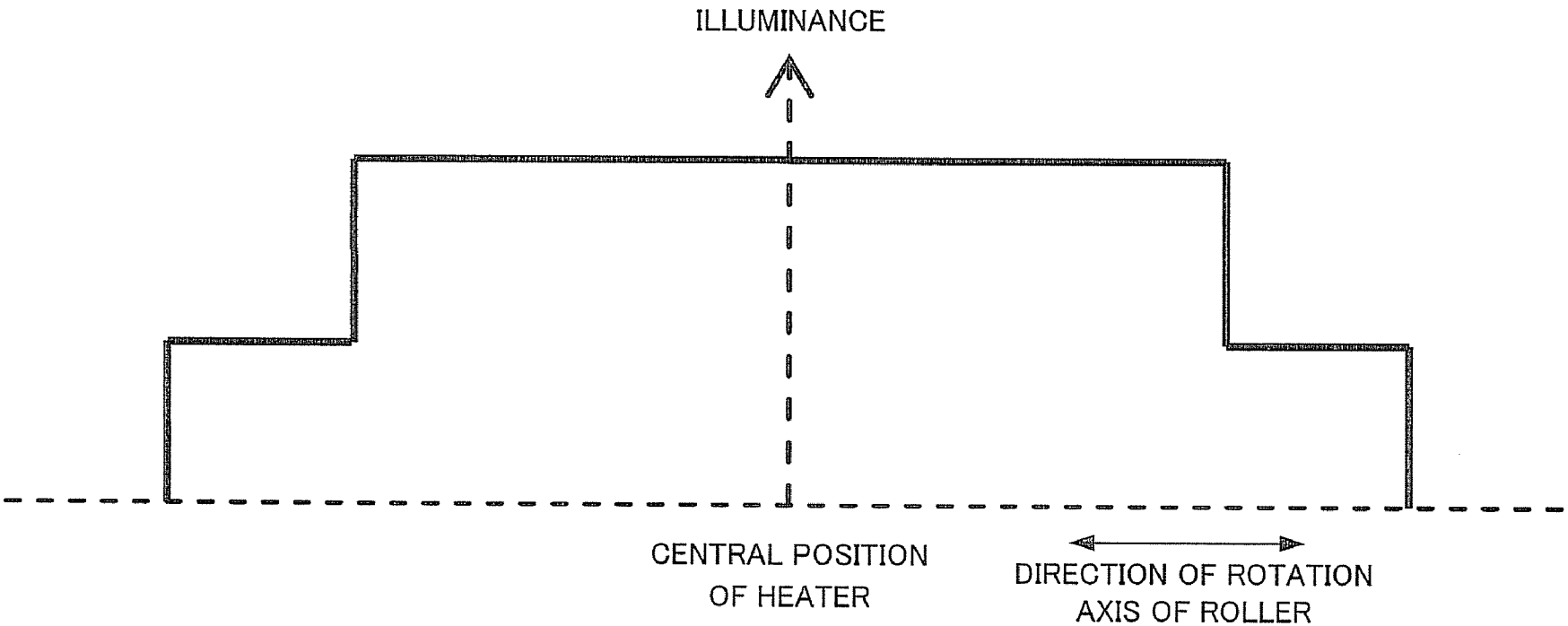
FIG. 4 is a graph showing illuminance distribution in a second heater L2.

The second heater L2 is arranged in a second range X2 which is different from the first range X1 in the direction of the rotation axis of the first roller 1 (the main heating target area is the vicinity of the center of the first roller 1; see FIG. 2). The second heater L2 thus serves to heat the first roller 1. FIG. 4 is a graph showing illuminance distribution in the second heater L2. Of course, the first range X1 and the second range X2 may partly overlap each other to a certain extent in the direction of the rotation axis of the first roller 1.

Figure 5:
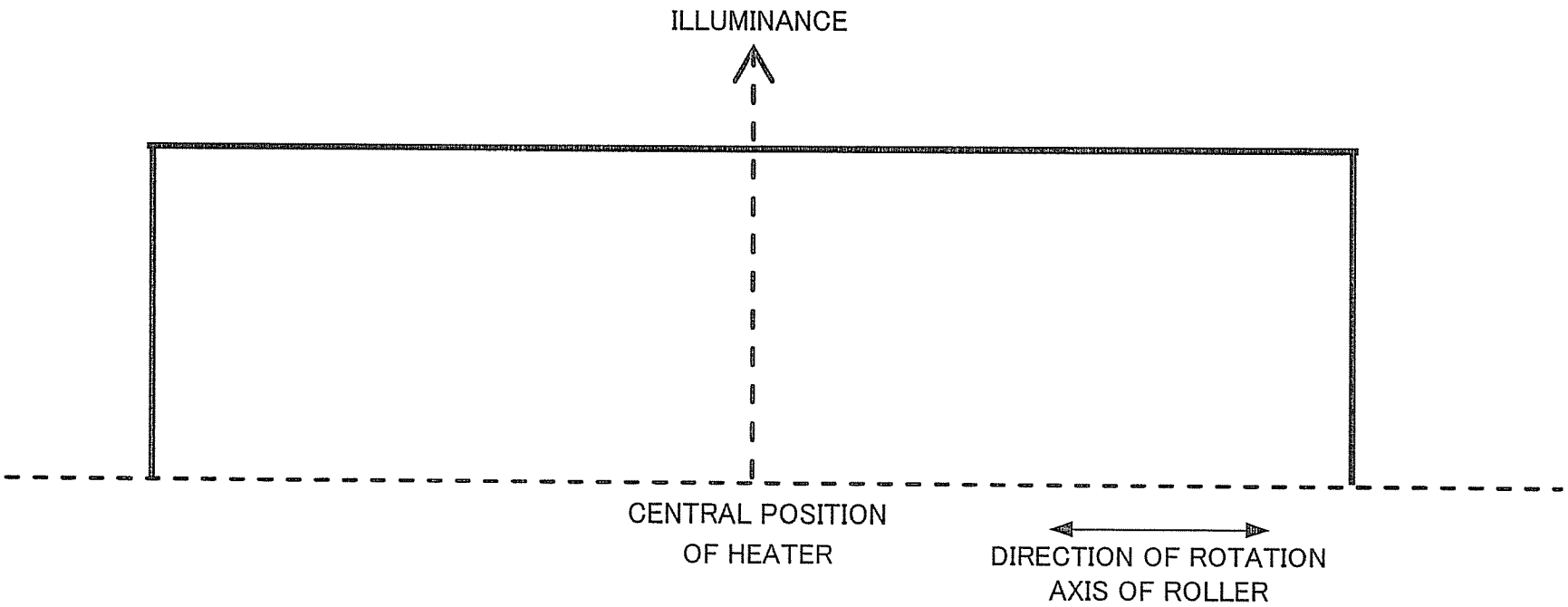
FIG. 5 is a graph showing illuminance distribution in an auxiliary heater L4.

The auxiliary heater L4 is arranged in a third range X3 including a part of or the entire first and second ranges in the direction of the rotation axis of the first roller 1 (the main heating target area is substantially the entire area of the first roller 1; see FIG. 2). The auxiliary heater L4 thus serves to heat the first roller 1. FIG. 5 is a graph showing illuminance distribution in the auxiliary heater L4.

Here, in this example, the auxiliary heater L4 is arranged in the first roller 1. However, the arrangement is not limited to this. For example, the auxiliary heater L4 may be arranged outside of the first roller 1 and may heat the first roller 1 from outside. The heating target of the auxiliary heater L4 need not necessarily be the first roller 1. For example, the belt 9 may be heated by the auxiliary heater L4.

The third heater L3 is arranged in a substantially entire area in the direction of the rotation axis of the second roller 2. Similar to the auxiliary heater L4, the third heater L3 serves to uniformly heat the second roller 2 in the direction of the rotation axis.

The heating control unit (heating control means) 101 reduces the quantity of power supply to the third heater L3 in predetermined timing accompanied by the start of fixing processing in the fixing apparatus, and starts power supply to the auxiliary heater L4.

The threshold setting unit 102 sets a first predetermined temperature in accordance with detected temperature by the ambient temperature detecting unit 103.

The ambient temperature unit (ambient temperature detecting means) 103 detects the ambient temperature of the environment in which the fixing apparatus is arranged.

The temperature detecting unit TH1 detects the temperature of the roller surface in the vicinity of the edges (the positions corresponding to the first heater L1) of the first roller 1.

The temperature detecting unit TH2 detects the temperature of the roller surface at the central position (the position corresponding to the second heater L2) of the first roller 1. Meanwhile, when heating by the auxiliary heater L4 is being carried out, the temperature detecting unit TH2 detects the temperature of the roller surface heated by the second heater L2 and the auxiliary heater L4.

The CPU 801 is responsible for carrying out various processing in the fixing apparatus and also responsible for realizing various functions by executing programs stored in the memory 802. The memory 802 includes, for example, a ROM or RAM, and serves to store various information and programs to be used in the fixing apparatus.

Next, operations of the fixing apparatus according to the embodiment of the invention will be described.

First, in the standby state where heating fixing processing to a sheet is not carried out, each heater provided in the first roller 1 and the second roller 2 is controlled to be at a predetermined temperature by the heating control unit 101.

When fixing processing is started, the second roller 2 and the third roller 3 rotate and the belt 9 turns by following these rollers. Thus, the belt 9 is heated by the first roller 1.

Figure 6:
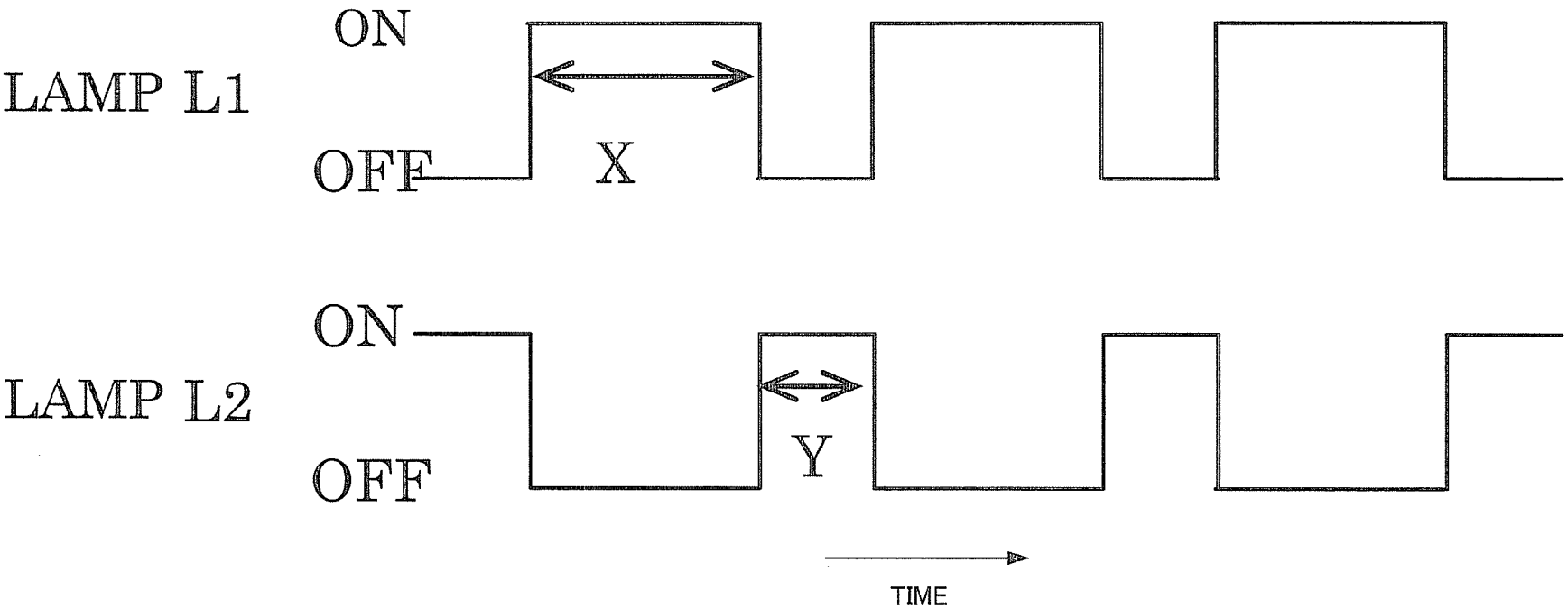
FIG. 6 is a timing chart showing turn-on patterns of the first heater L1 and the second heater L2.

FIG. 6 is a timing chart showing turn-up patterns of the first heater L1 and the second heater L2. As shown in FIG. 6, during execution of fixing processing, the first heater L1 and the second heater L2 are not simultaneously turned on. These heaters are alternately turned on to heat the first roller 1.

Here, an alternate turn-on cycle and a duty ratio are prescribed, thereby turning on the first heater L1 and the second heater L2 alternately. The alternate turn-on cycle refers to the time (X+Y) when the first heater L1 and the second heater L2 are turned on once each, as shown in FIG. 6. The duty ratio prescribes the turn-on ratio (X/(X+Y)) with respect to the alternate turn-on cycle of the first heater L1 and the second heater L2. The third heater L3 is independent of the first heater L1 and the second heater L2. The third heater L3 turns on and heats when the temperature detected by the temperature detecting unit TH3 is below a preset temperature.

Figure 7:
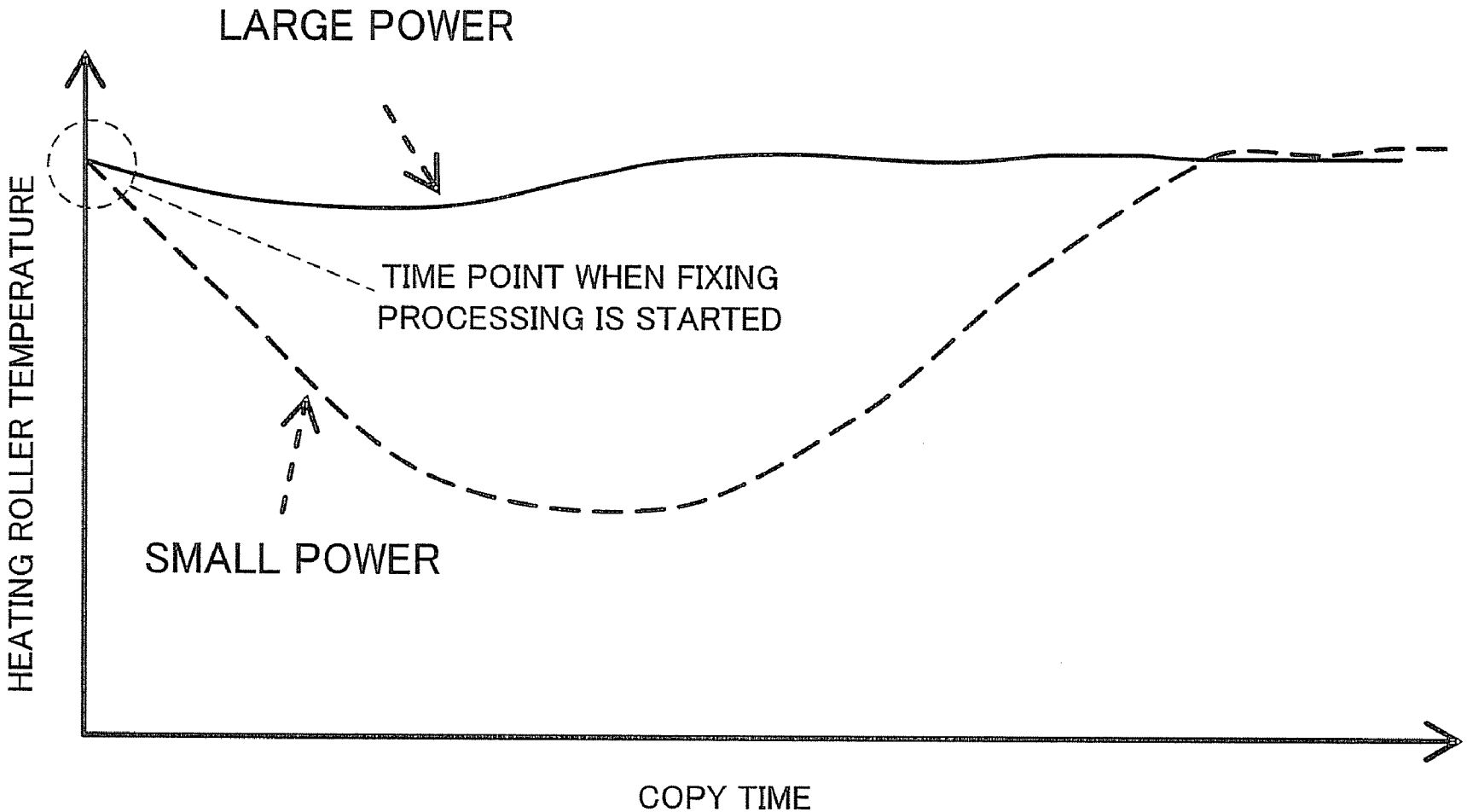
FIG. 7 is a graph showing transition of surface temperature of a first roller 1.

Generally, as the number of sheets increases to which fixing processing is carried out per unit time, the temperature of the first roller 1 and the second roller 2 falls because the quantity of heat supplied by the first heater L1 and the second heater L2 is less than the quantity of heat that is deprived of by the sheet to which fixing processing is carried out and the third roller 3. FIG. 7 is a graph showing transition of the surface temperature of the first roller 1.

As shown in FIG. 7, for a certain time period (several ten seconds) from the start of fixing processing, a large quantity of heat is deprived of by the third roller 3 and the like and the temperature falls sharply. If the temperature of the first roller 1 and the second roller 2 falls extremely, a fixing defect occurs and fixing processing is interrupted in order to prevent the occurrence of a fixing defect (copy stop processing). Therefore, productivity is lowered. Of course, if the quantity of heat supplied by the heater lamp is increased, it can compensate for sudden temperature fall, as shown in FIG. 7. However, since the maximum available power is limited (1500 W in Japan), this measure cannot be often employed practically. Meanwhile, there is a technique of controlling the voltage inputted to each heater lamp and thus controlling the power of the heater lamp. However, a circuit for realizing such control is necessary and it obstructs reduction in cost.

Thus, in this embodiment, temperature control of each heater is carried out in the following manner.

The first heater L1, the second heater L2 and the auxiliary heater L4 arranged in the first roller 1 are configured in such a manner that temperature control of each of these heaters can be carried out separately from each other. The first heater L1 or the second heater L2 and the auxiliary heater L4 can simultaneously be turned on. The auxiliary heater L4 and the third heater L3 are not turned on simultaneously.

Figure 8:
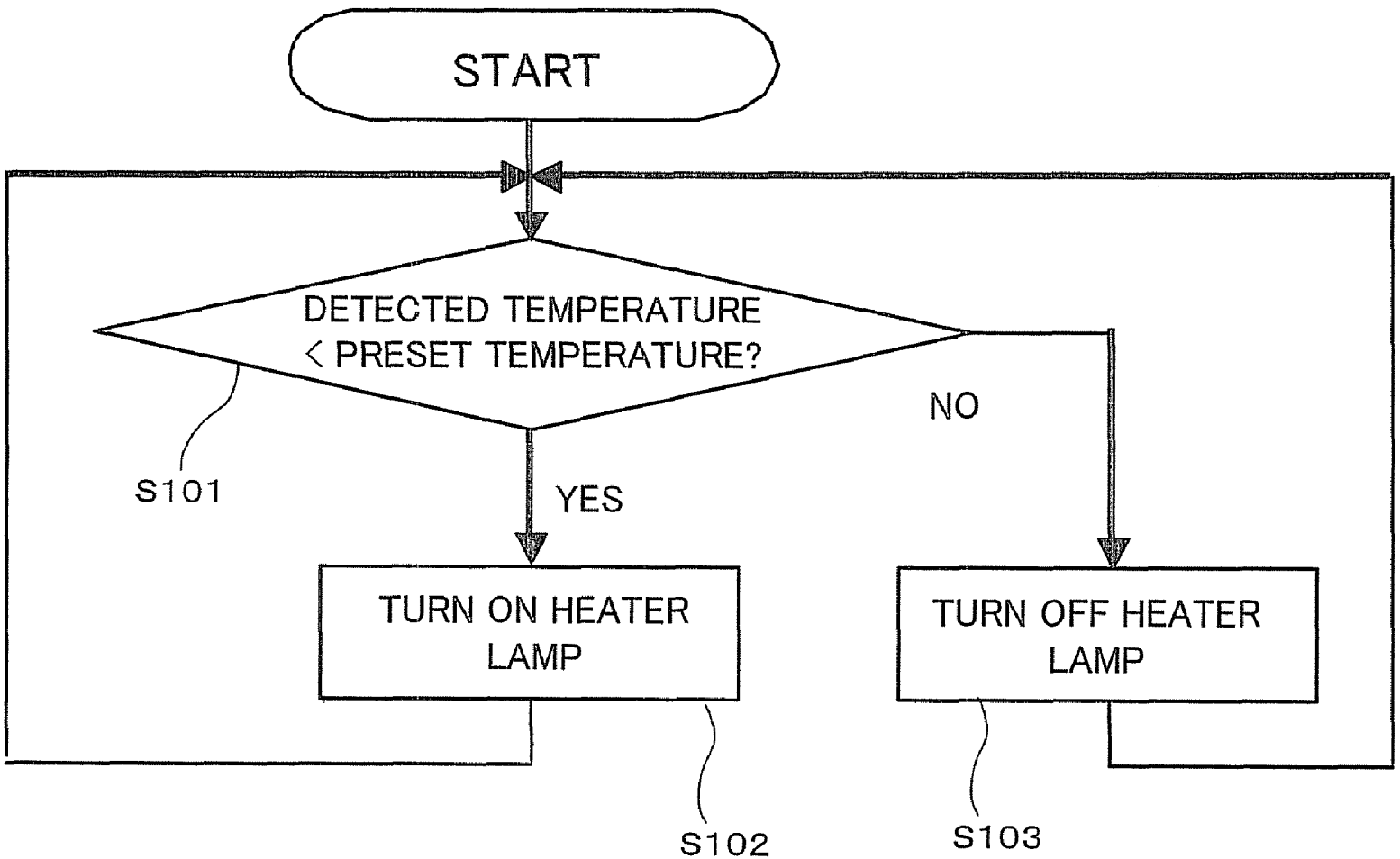
FIG. 8 is a flowchart for explaining basic turn-on control of the third heater L3 and the auxiliary heater L4.

FIG. 8 is a flowchart for explaining basic turn-on control of the third heater L3 and the auxiliary heater L4.

During fixing processing, since a predetermined priority period has been set for the auxiliary heater L4 and the third heater L3, respectively, the heat control unit 101 turns on or off the heater lamp that should be given priority during the priority period, in accordance with the detected temperature and target temperature.

If the roller surface temperature detected by the temperature detecting unit is lower than a preset temperature (Yes in S101), the corresponding heater lamp is turned on to heat to the preset temperature (S102). On the other hand, if the detected temperature is higher than the preset temperature (No in S101), the heater lamp that has been on is turned off (S103).

Figure 9:
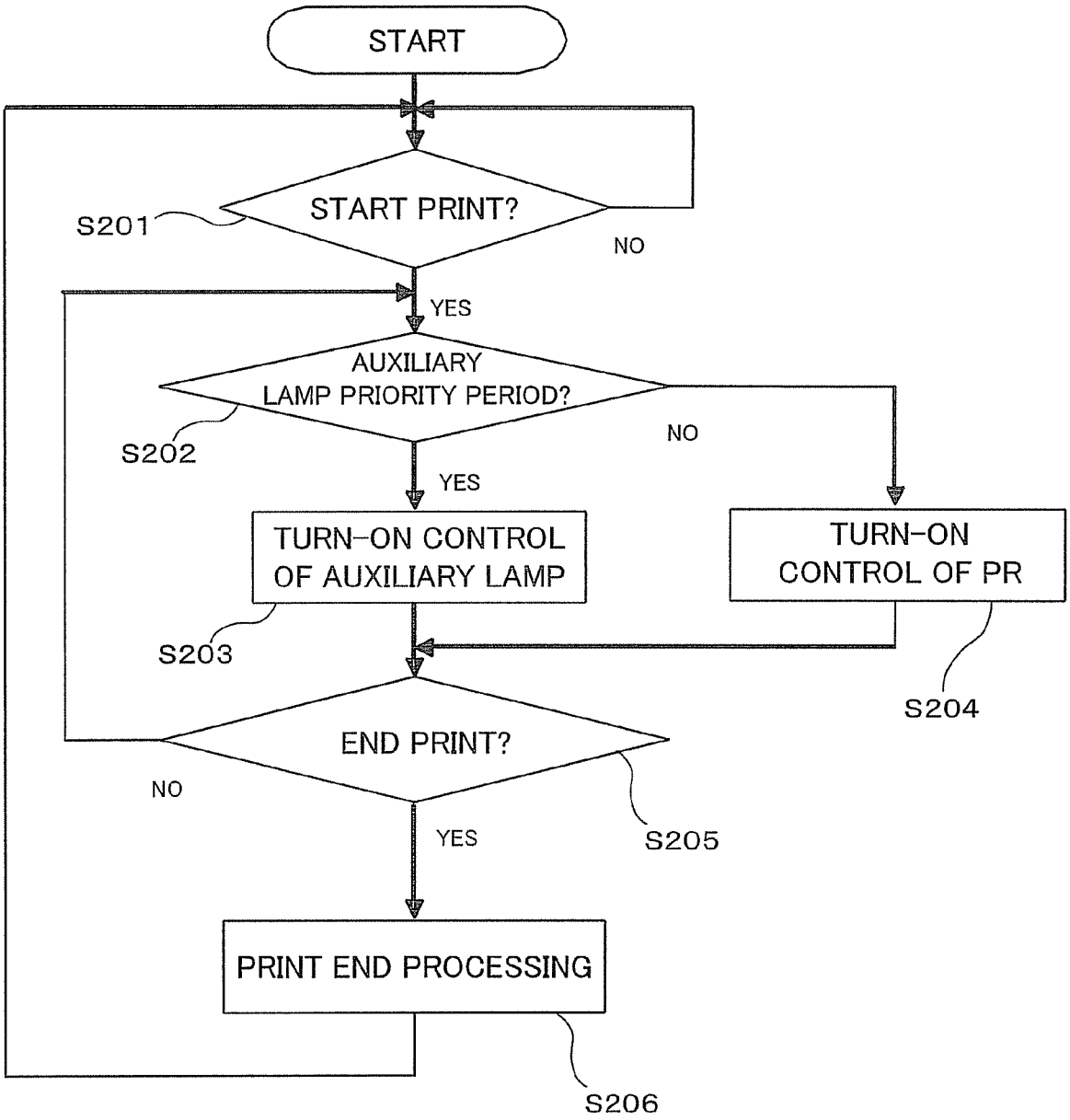
FIG. 9 is a flowchart for explaining the details of turn-on switching method for the third heater L3 and the auxiliary heater L4.
Figure 10:
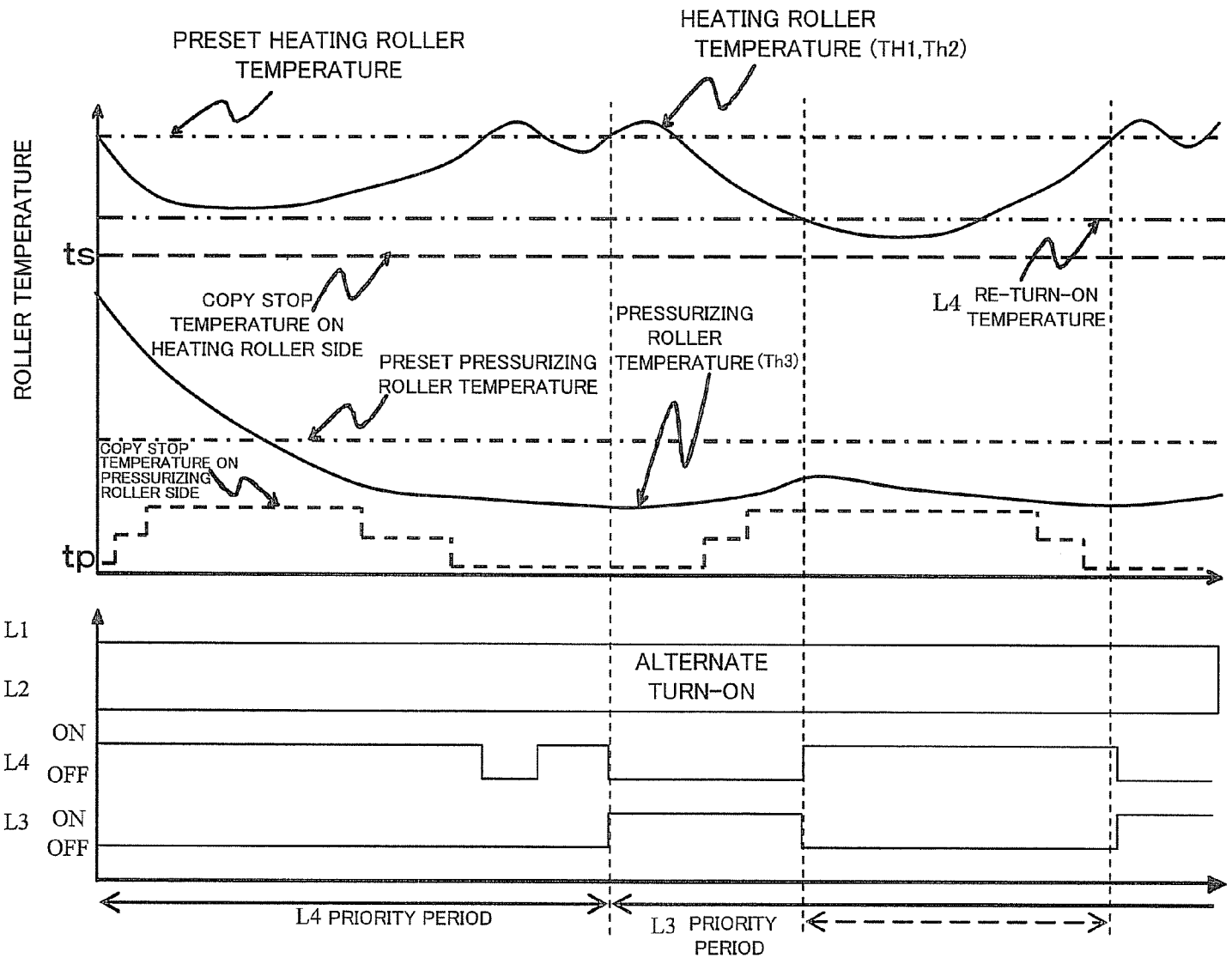
FIG. 10 is a graph showing turn-on timing for the first to third heaters L1-L3 and the auxiliary heater L4, and temperature changes in the first roller 1 and the second roller 2.

FIG. 9 is a flowchart for explaining the details of a turn-on switching method for the third heater L3 and the auxiliary heater L4. FIG. 10 is a graph showing turn-on timing for the first to third heaters L1-L3 and the auxiliary heater L4, and temperature changes in the first roller 1 and the second roller 2. Hereinafter, in the flowchart, the second roller 2 equivalent to a pressurizing roller is described as "PR" for the convenience of description space. In each drawing, "fixing processing" in the fixing apparatus is expressed as "copy processing" when necessary, on the assumption that the fixing apparatus according to this embodiment is provided in an image forming apparatus that carries out image forming processing and image reading processing.

Figure 11:
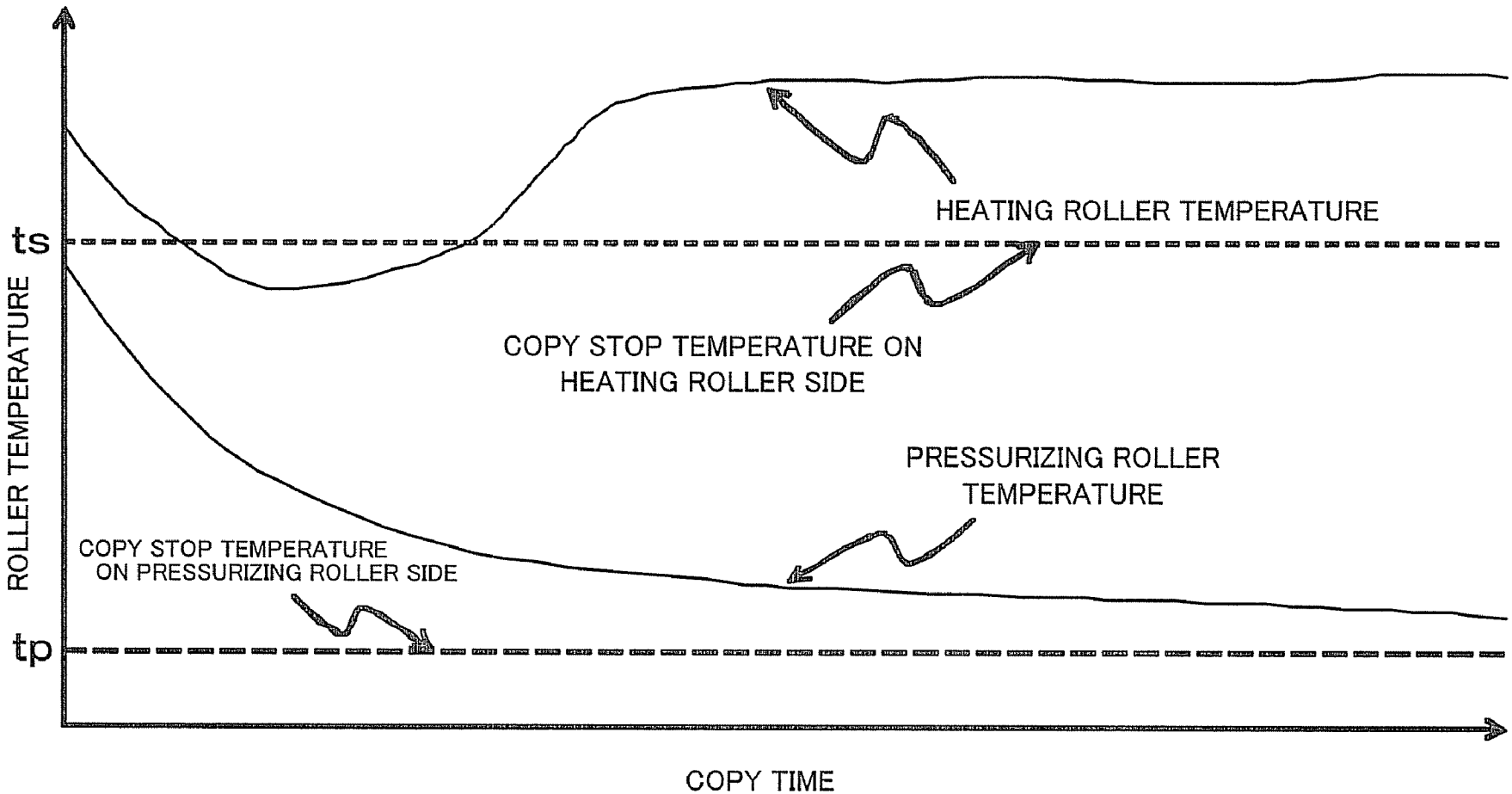
FIG. 11 is a graph for explaining temperature fall in the first roller 1 and the second roller 2 at the start of fixing processing.

At the start of fixing processing, the temperature of the first roller 1 and the second roller 2 (particularly the first roller 1) falls, as shown in FIG. 11. The heating control unit 101 in this embodiment stops fixing processing in the fixing apparatus in order to avoid occurrence of a fixing defect, when the temperature of the first roller 1 falls below a copy stop temperature ts (second predetermined temperature) at the time of execution of fixing processing in the fixing apparatus.

To prevent deterioration in productivity due to such interruption of fixing processing, in this embodiment, a period from the start of fixing processing until a predetermined time passes (S201, S202) is set as an "auxiliary heater L4 priority period", during which turning on of the auxiliary heater L4 is given priority. During this priority period, the heating control unit 101 turns on the auxiliary heater L4 (S203) and turns off the third heater L3 (see FIG. 10).

Thus, heating by the auxiliary heater L4 turned on by the power acquired by turning off the third heater L3 is carried out in addition to heating by the first heater L1 or the second heater L2. In this way, temperature fall in the first roller 1 at the start of fixing processing is restrained and the temperature is maintained above the copy stop temperature ts.

Of course, if power that is enough to turn on the auxiliary heater L4 can be secured simply by reducing the power supply to the third heater L3 to a certain rate (for example, 20%) instead of completely stopping the power supply to the third heater L3, the power supplied to the third heater L3 may be reduced during the auxiliary heater L4 priority period.

In this way, during the priority period at the start of fixing processing, the power supplied to the third heater L3 is switched to be supplied to the auxiliary heater L4. Thus, the overall power consumption by the first to third heaters and the auxiliary heater does not have to be increased even when auxiliary heating is carried out by the auxiliary heater L4.

However, if the state of S203 continues, the temperature of the second roller 2 approaches a copy stop temperature tp, after the end of the auxiliary heater L4 priority period (No in S202), a "third heater L3 priority period" is set, during which turning on of the third heater L3 is given priority. During this priority period, the heating control unit 101 turns on the third heater L3 (S204) and turns off the auxiliary heater L4. Thus, the temperature of the second roller 2 is maintained above the copy stop temperature tp.

When fixing processing has ended (Yes in S205), it is considered that fixing processing (that is, print processing) has ended (S206) and the operation returns to the initial processing (S201).

Figure 12:
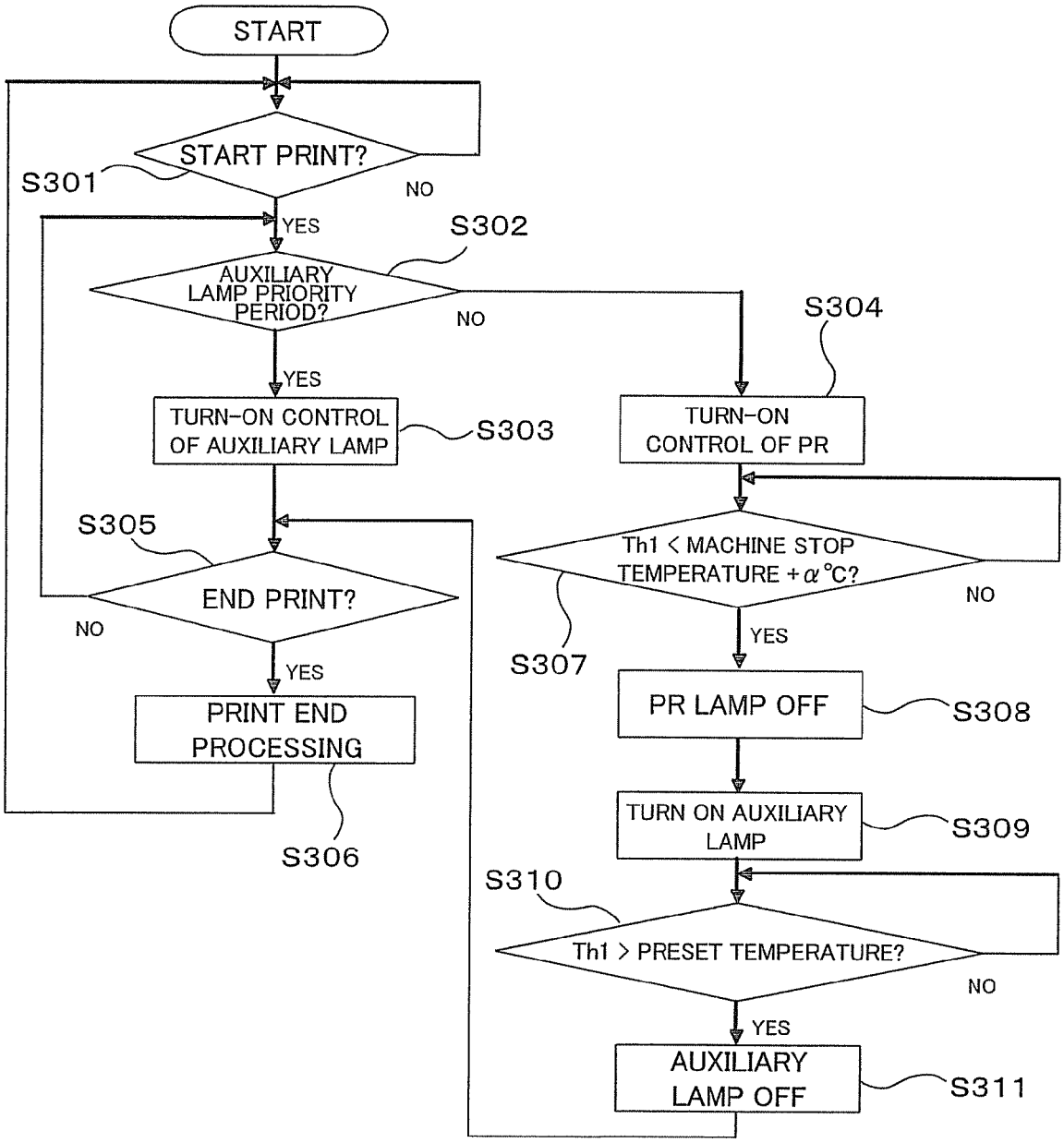
FIG. 12 is a flowchart for explaining the details of another turn-on switching method for the third heater L3 and the auxiliary heater L4.

FIG. 12 is a flowchart for explaining the details of another turn-on switching method for the third heater L3 and the auxiliary heater L4. In steps S301 to S306 in FIG. 12, the processing similar to steps S201 to S206 in FIG. 9 is carried out. Therefore, these steps will not be described further in detail.

The temperature detected by the temperature detecting units TH1 and TH2 may be lowered again to the fixing processing stop temperature ts or below after the third heater L3 priority period, depending on the use environment including the basis weight of paper, the circumstances of the power source and temperature.

Thus, if the temperature detected by the temperature detecting unit TH1 or TH2 has reached the temperature the fixing processing stop temperature ts+$\alpha$° C. (first predetermined temperature) or below (Yes in S307) when the third heater L3 is on, the heating control unit 101 turns off the third heater L3 (S308) and restores the auxiliary heater L4 priority period to turn on the auxiliary heater L4 (S309). The heating control unit 101 continues this heating by the auxiliary heater L4 until the temperature detected by the temperature detecting unit TH1 or TH2 reaches the target temperature of the first roller 1. When the temperature detected by the temperature detecting unit TH1 or TH2 has reached the preset temperature of the first roller 1 or above, the heating control unit 101 restores the third heater L3 priority period.

Also, in this embodiment, in order to prevent temperature rise at the edge with a small-size paper, when the difference between the temperatures detected by the temperature detecting unit TH1 and the temperature detecting unit TH2 has reached a predetermined value or above during the auxiliary heater L4 priority period, the heating control unit 101 shifts to the third heater L3 priority period even when it is still in the auxiliary heater L4 priority period.

In the case of carrying out fixing processing to a small-size sheet, the edges of the roller do not contact the sheet. Therefore, the edges are not deprived of heat and the temperature rises there. To prevent this, the heating parts of the first heater L1 and the second heater L2 are separated. However, in the case where the auxiliary heater L4 which heats the entire roller is added as in this embodiment, the temperature of the edges may rise at the time of performing fixing processing to a small-size sheet. In order to prevent this, when the temperature difference between the temperature detecting unit TH1 and the temperature detecting unit TH2 has become TH2−TH1>$\beta$° C., the operation shifts to the third heater L3 priority period even though it is still in the auxiliary heater L4 priority period. Thus, the auxiliary heater L4 is turned off and the temperature rise at the edges of the roller is prevented from reaching a predetermined value or above.

The threshold setting unit (threshold setting means) can set the fixing processing stop temperature ts in accordance with the temperature detected by the temperature detecting unit TH1 or in accordance with both temperatures detected by the temperature detecting unit TH1 and the temperature detecting unit TH2 (in accordance with the temperature relation between the first roller 1 and the second roller 2).

Figure 13:
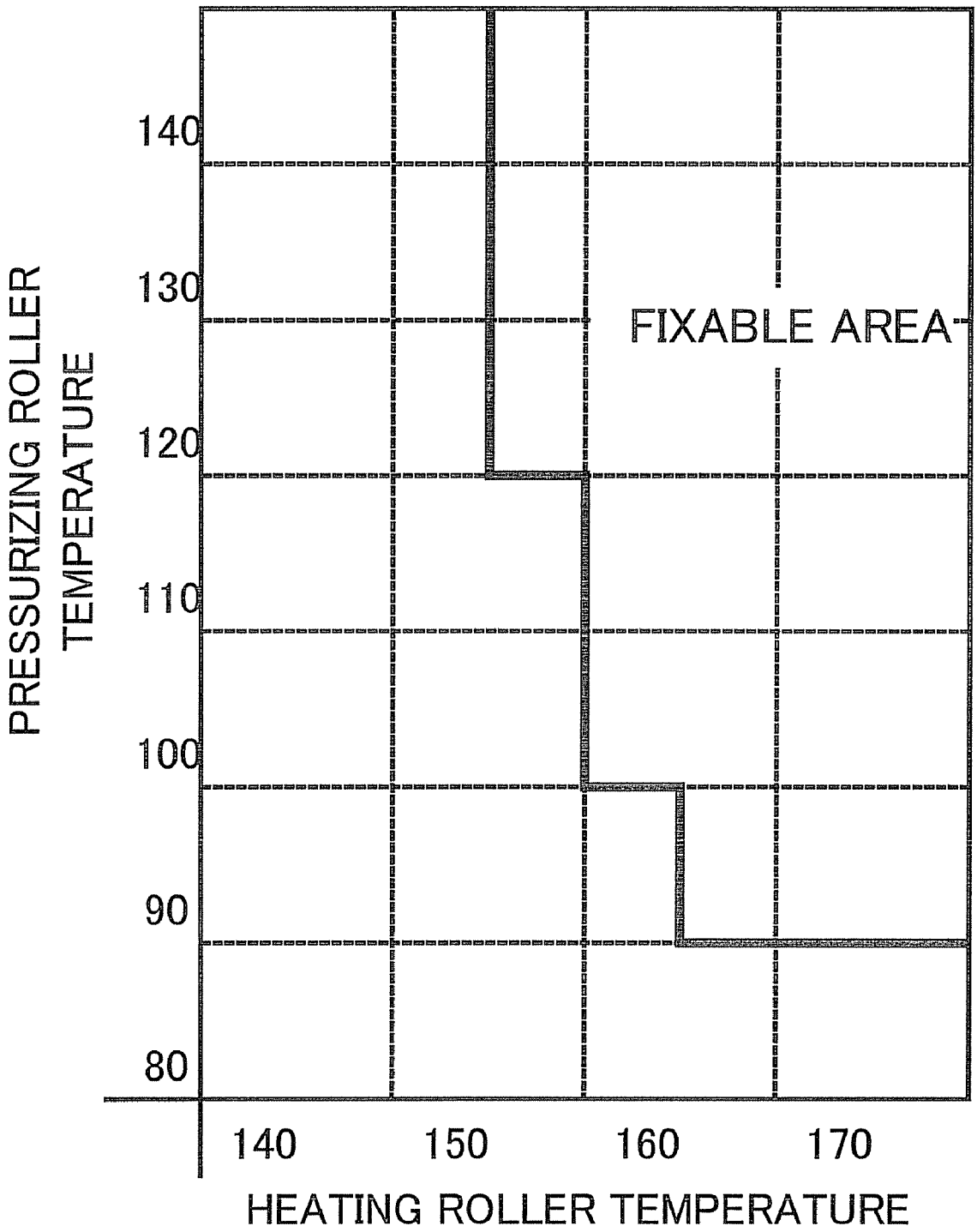
FIG. 13 is a graph for explaining a method of deciding a fixing processing stop temperature ts.

As shown in FIG. 13, the fixing processing stop temperature ts (threshold value of fixing-enable temperature) is decided on the basis of the temperature of the first roller 1 and the temperature of the second roller 2.

In this embodiment, since the second roller 2 cannot be heated during a predetermined period from the start of fixing processing (the auxiliary heater L4 priority period), the surface temperature of the second roller 2 falls sharply (see FIG. 10). Here, when the temperature of the first roller 1 or the second roller 2 has become lower than a fixation-enable temperature, fixing processing is interrupted in order to avoid occurrence of a fixing defect. If the copy stop temperature condition is set at a predetermined temperature for both the first roller 1 and the second roller 2 (for example, 155° C. for the first roller 1 and 120° C. for the second roller 2), the fixation-enable temperature can frequently be reached in the configuration as in this embodiment (particularly in the second roller 2). Such frequent interruption of fixing processing adversely affects productivity.

To solve this problem, in this embodiment, the fixing processing stop temperature ts set for the first roller 1 is kept constant (for example, 155° C.) and the fixing processing stop temperature tp set for the second roller 2 is decided in accordance with the temperature of the first roller 1 at that time (see FIG. 14). Thus, the probability that fixing processing will be interrupted can be reduced.

In this way, according to this embodiment, temperature fall in the first roller 1 and the second roller 2 due to passage of paper or the like at the time of fixing processing can be restrained without significantly increasing the overall power consumption by the fixing apparatus.

In this embodiment, the power consumption by the auxiliary heater L4 is set to be equal to or lower than the power consumption by the third heater L3. Thus, the power necessary for the auxiliary heater L4 can completely be provided simply by turning off the third heater L3. Therefore, it is not necessary to particularly increase the overall power consumption by the fixing apparatus in order to carry out auxiliary heating by the auxiliary heater L4.

In the above embodiment, the auxiliary heater L4 is provided in the first roller 1, as an exemplary configuration. However, the configuration to restrain temperature fall in the first roller 1 is not necessarily limited to this. For example, the power acquired by turning off the third heater L3 can be additionally supplied to the first heater L1 and the second heater L2, and consequently the temperature of the first roller 1 can be maintained.

Each step of the processing in the above fixing apparatus is realized by causing the CPU 801 to execute the temperature control program stored in the memory 802.

An image forming apparatus having the fixing apparatus according to this embodiment can be provided, as a matter of course. This image forming apparatus can include, for example, a multi-function peripheral (MFP).

In this embodiment, the functions to carry out the invention have been recorded in advance in the apparatus. However, the configuration is not limited to this. The similar functions may be downloaded to the apparatus from a network. Alternatively, the similar functions stored in a recording medium may be installed in the apparatus. As the recording medium, any form of recording medium that can store a program and that can be read by the apparatus can be employed, such as CD-ROM. Moreover, the functions acquired in advance by being installed or downloaded as described above may be realized in cooperation with the operating system (OS) in the apparatus.

The specific embodiment of the invention has been described in detail. However, it is obvious to those skilled in the art that various changes and modifications can be made without departing from the spirit and scope of the invention.

As described above in detail, according to the invention, a technique can be provided that enables restraining temperature fall in the heating roller and the pressurizing roller due to passage of paper or the like at the time of fixing processing without greatly increasing the overall power consumption by the fixing apparatus.

What is claimed is:

1. A fixing apparatus that fixes a developer image onto a sheet by heating, comprising:

a first heater which is arranged in a first range in the direction of a rotation axis of a first roller and heats the first roller;

a second heater which is arranged in a second range different from the first range in the direction of the rotation axis of the first roller and heats the first roller;

an auxiliary heater which is arranged in a third range including the first and second ranges in the direction of the rotation axis of the first roller and heats the first roller;

a third heater which heats a second roller nipping and carrying a sheet in cooperation with the first roller; and a heating control unit configured to reduce a quantity of power supply to the third heater in predetermined timing accompanied by start of fixing processing in the fixing apparatus, and starts power supply to the auxiliary heater.

2. The fixing apparatus according to claim 1, wherein the heating control unit reduces the quantity of power supplied to the third heater and causes power supply to the auxiliary heater to be carried out, within a period from the start of fixing processing in the fixing apparatus until a predetermined time passes.

3. The fixing apparatus according to claim 1, comprising:

a temperature detecting unit configured to detect the temperature of the first roller;

wherein when the temperature detected by the temperature detecting unit becomes lower than a first predetermined temperature at the time of executing fixing processing in the fixing apparatus, the heating control unit reduces the quantity of power supplied to the third heater and starts power supply to the auxiliary heater.

4. The fixing apparatus according to claim 1, comprising:

an ambient temperature detecting unit configured to detect ambient temperature in an environment where the fixing apparatus is arranged; and a threshold setting unit configured to set the first predetermined temperature in accordance with the temperature detected by the ambient temperature detecting unit.

5. The fixing apparatus according to claim 1, wherein the auxiliary heater is arranged in the first roller.

6. The fixing apparatus according to claim 1, wherein power consumption by the auxiliary heater is set to be equal to or less than power consumption by the third heater.

7. The fixing apparatus according to claim 1, wherein the first range is a vicinity of both edges of the first roller, the second range is a vicinity of the center of the first roller, and the third range is a substantially entire area of the first roller.

8. The fixing apparatus according to claim 1, wherein when the temperature of the first roller becomes lower than a second predetermined temperature at the time of executing fixing processing in the fixing apparatus, the heating control unit stops fixing processing in the fixing apparatus, and wherein the apparatus comprises:

a temperature detecting unit configured to detect the temperature of the first roller; and a threshold setting unit configured to set the second predetermined temperature in accordance with the temperature detected by the temperature detecting unit.

9. The fixing apparatus according to claim 1, wherein the second roller nips and carries a sheet in cooperation with a belt wound on the first roller.

10. A temperature control method for a fixing apparatus that fixes a developer image onto a sheet by heating, wherein the fixing apparatus comprises a first roller which has first and second heaters arranged in different ranges from each other in the direction of a rotation axis and an auxiliary heater arranged in a range including the ranges where the first and second heaters are arranged in the direction of the rotation axis, and a second roller which is heated by a third heater and nips and carries a sheet in cooperation with the first roller, the method comprising:

determining predetermined timing accompanied by start of fixing processing in the fixing apparatus, and when it is determined that the predetermined timing has been reached, reducing quantity of power supply to the third heater and starting power supply to the auxiliary heater.

11. The temperature control method according to claim 10, wherein the quantity of power supplied to the third heater is reduced and power supply to the auxiliary heater is carried out, within a period from the start of fixing processing in the fixing apparatus until a predetermined time passes.

12. The temperature control method according to claim 10, wherein the temperature of the first roller is detected, and when the temperature detected by the temperature detecting unit becomes lower than a first predetermined temperature at the time of executing fixing processing in the fixing apparatus, the quantity of power supplied to the third heater is reduced and power supply to the auxiliary heater is started.

13. The temperature control method according to claim 10, wherein ambient temperature in an environment where the fixing apparatus is arranged is detected, and the first predetermined temperature is set in accordance with the detected temperature.

14. The temperature control method according to claim 10, wherein the auxiliary heater is arranged in the first roller.

15. The temperature control method according to claim 10, wherein power consumption by the auxiliary heater is set to be equal to or less than power consumption by the third heater.

16. The temperature control method according to claim 10, wherein in the direction of rotation axis of the first roller, the first heater is arranged in a vicinity of both edges of the first roller, the second heater is arranged in a vicinity of the center of the first roller, and the auxiliary heater is arranged in a substantially entire area of the first roller.

17. The temperature control method according to claim 10, wherein when the temperature of the first roller becomes lower than a second predetermined temperature at the time of executing fixing processing in the fixing apparatus, fixing processing in the fixing apparatus is stopped, and wherein the temperature of the first roller is detected, and the second predetermined temperature is set in accordance with the detected temperature.

18. The temperature control method according to claim 10, wherein the second roller nips and carries a sheet in cooperation with a belt wound on the first roller.

19. The temperature control method according to claim 10, further comprising:

detecting the temperature of the first and second rollers; and when the difference between the detected temperature of the first roller and the detected temperature of the second roller becomes higher than a predetermined temperature at the time of executing fixing processing in the fixing apparatus, reducing the quantity of power supplied to the auxiliary heater and starting power supply to the third heater.

20. A fixing apparatus that fixes a developer image onto a sheet by heating, comprising:

a first heater which is arranged in a first range in the direction of a rotation axis of a first roller and heats the first roller;

a second heater which is arranged in a second range different from the first range in the direction of the rotation axis of the first roller and heats the first roller;

an auxiliary heater which is arranged in a third range including the first and second ranges in the direction of the rotation axis of the first roller and heats the first roller;

a third heater which heats a second roller nipping and carrying a sheet in cooperation with the first roller;

a first temperature detecting unit configured to detect the temperature of the first roller corresponding to the first range;

a second temperature detecting unit configured to detect the temperature of the first roller corresponding to the second range; and a heating control unit configured to reduce a quantity of power supply to the third heater in predetermined timing accompanied by start of fixing processing in the fixing apparatus, and starts power supply to the auxiliary heater, and configured to reduce a quantity of power supply to the auxiliary heater, even if in the predetermined timing, when temperature difference between a first temperature detected by the first temperature detecting unit and a second temperature detected by the second temperature detecting unit higher than a predetermined temperature.

* * * * *